United States Patent [19]

Bühl et al.

[11] Patent Number: 4,811,701

[45] Date of Patent: Mar. 14, 1989

[54] COATED VALVE FOR INTERNAL COMBUSTION ENGINE

[75] Inventors: Horst Bühl, Endersbach; Wolfgang Kleinekathöfer, Waldstetten; Eggert Tank, Wernau, all of Fed. Rep. of Germany

[73] Assignee: Daimler-Benz Aktiengesellschaft, Fed. Rep. of Germany

[21] Appl. No.: 201,894

[22] Filed: Jun. 3, 1988

[30] Foreign Application Priority Data

Jun. 6, 1987 [DE] Fed. Rep. of Germany ..... 3719077

[51] Int. Cl.[4] ..... F01L 3/00

[52] U.S. Cl. ..... 123/188 AA; 427/376.5

[58] Field of Search ..... 123/188 AA, 1 A; 251/368

[56] References Cited

U.S. PATENT DOCUMENTS

| | | | |
|---|---|---|---|
| 4,27,721 | 1/1984 | Cairns | 427/376.5 |
| 4,362,134 | 12/1982 | Worthen | 123/188 AA |
| 4,612,880 | 9/1986 | Brass et al. | 123/1 A |

FOREIGN PATENT DOCUMENTS

| | | | |
|---|---|---|---|
| 0086938 | 1/1983 | European Pat. Off. . | |
| 2056502 | 3/1981 | United Kingdom | 123/188 AA |
| 2072222 | 9/1981 | United Kingdom | 123/188 AA |

*Primary Examiner*—E. Rollins Cross

*Attorney, Agent, or Firm*—Barnes & Thornburg

[57] ABSTRACT

A coated valve, in particular an inlet valve for internal combustion engines, is provided, which is provided with a deposit preventing layer containing cerium (IV) oxide. A process for coating a valve with the deposit preventing layer containing cerium (IV) oxide is also provided.

8 Claims, 1 Drawing Sheet

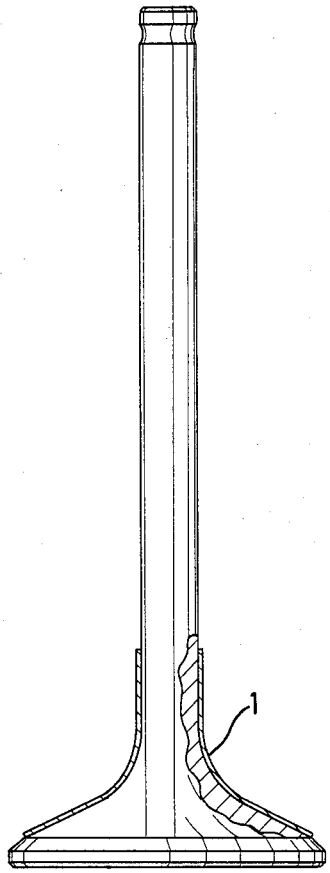
1

COATED VALVE FOR INTERNAL COMBUSTION ENGINE

BACKGROUND AND SUMMARY OF THE INVENTION

The invention relates to a coated valve for internal combustion engines having a layer which prevents deposits.

The coking of valves is a problem which has long been known, in particular in the case of inlet valves of Otto engines. Coking is understood to mean black, hard deposits which are produced mainly by combustion and decomposition residues of the fuel.

The requirements, which have been increasing for some years, imposed on the emission behavior, higher power outputs and lower fuel consumption, result in engines which are operated with a leaner fuel/air mixture. These requirements, as well as the use of unleaded fuel, result in the valves being more easily coked, and a coking of the valves manifests itself in a more troublesome manner than before.

The negative effects of inlet valve coking include poor cold running, poor gas admission, particularly in the warming-up phase, an increase in the fuel consumption and pollutant emission associated therewith, as well as a drop in power due to interference in the inlet air passage and out-of-true engine running. In addition, coke particles may damage the valve seating surfaces, which results in leaky valves.

Attempts to prevent coking of the inlet valves have included adding additives to the fuel, and also providing the valves with a layer which prevents deposits. Thus, it is shown in German Unpublished Patent Application No. 3,517,914 to provide inlet valves with a polytetrafluoroethylene layer. However, in practice such layers have not resulted in success.

An object of the present invention is to provide a coated valve for internal combustion engines having a layer which prevents deposits, and in which the formation of deposits is reliably prevented even in the long term.

These objects and other objects are achieved according to the present invention, by providing a value with a deposit preventing layer of cerium (IV) oxide. It was discovered that coking substantially ceases with the coating of the valve with cerium (IV) oxide. A method of coating a valve with the deposit preventing layer is also provided.

It is contemplated that the layer be applied to the valve by any desired manner and means. In certain preferred embodiments, it is preferable to produce the layer by plasma jet spraying of cerium (IV) oxide. In certain preferred embodiments, the cerium (IV) oxide powder, which expediently has a particle size of 40–100 μm may contain in addition small quantities of other oxides, such as $TiO_2$, $Cr_2O_3$, $V_2O_5$, FeO etc. Since, however cerium (IV) oxide represents the active constituent of the layer, the layer should contain as much cerium (IV) oxide as possible, and at least 90% by weight.

According to advantageous features of certain preferred embodiments of the invention, the thickness of the cerium (IV) oxide layer applied should be about 0.1 to 1.5 mm. In certain particularly preferred embodiments, the layer thickness is between 0.15 and 0.4 mm.

It is contemplated that the adjustment of the jet spraying parameters in plasma jet spraying is critical for the mechanical properties of the layer applied. The quality of the layer can be influenced by varying the jet spraying distances. A small jet spraying distance produces mainly a cerium (IV) oxide layer of a porous and soft nature. Larger jet spraying distance produces higher proportions of $Ce_2O_3$, which does not have a catalytic action but is of a harder and firmer or more dense nature. In certain preferred embodiments, these proportions of $Ce_2O_3$ can be converted into cerium (IV) oxide by a simple oxidation treatment, for example heating for 10 to 20 minutes at 400° C. in air, without the mechanical properties of the layer being affected.

According to advantageous features of certain preferred embodiments of the invention, to improve the adhesion of the cerium (IV) oxide layer, an adhesion layer is provided in a manner known per se between the cerium (IV) layer and the valve material. Such adhesion layers are often used in flame jet spraying or plasma jet spraying technology, and include in general, sprayed-on layers of a nickel/-or optionally cobalt-containing nickel/chromium/aluminum alloy. These adhesion promotion layers are usually applied in a layer thickness of between 0.05 and 0.1 mm.

According to other advantageous features of certain preferred embodiments of the invention, the cerium (IV) oxide layer covers the entire valve with the exception of the seating and guide surface. However, in certain preferred embodiments, the valve has the cerium (IV) oxide layer only on the surface regions which are endangered by deposits. These are, in particular, the rear part of the valve head, and also the part of the valve stem adjacent thereto.

Other objects, advantages and novel features of the present invention will become apparent from the following detailed description of the invention when considered in conjunction with the accompanying drawings.

BRIEF DESCRIPTION OF THE DRAWING FIGURE

The drawing FIGURE is a partial cross-sectional view of a valve including a cerium (IV) oxide layer according to certain preferred embodiments of the present invention.

DETAILED DESCRIPTION OF THE DRAWING

The effectiveness of the cerium (IV) oxide coating is demonstrated on the basis of the following examples. These examples are offered by way of illustration only and should not be construed as limiting the scope of the present invention in any way.

EXAMPLE 1

A four-cylinder Otto engine type 102 manufactured by Daimler-Benz having a piston displacement of 1997 $cm^3$, a compression ratio of =9.1 and a power output of 90 kW at 5100 rev/min was provided with three coated inlet valves and one uncoated inlet valve. The coated inlet valves carried a 0.3 mm thick layer, about 96% by weight of which consisted of cerium (IV) oxide. As shown in the drawing FIGURE, the coating layer 1 was disposed on the rear part of the valve head and also on the part of the valve stem adjacent thereto.

The engine was run with unleaded premium fuel which contained no special additives for reducing valve coking. After covering a distance of 40,000 km in normal road traffic, a coke layer 1 to 1.5 mm thick had formed on the uncoated valve. The coated valves were free of deposits.

EXAMPLE 2

A six-cylinder Otto engine type 103 manufactured by Daimler-Benz having a piston displacement of 2962 $cm^3$, a compression ratio of =9.2 and a power output of 132 kW at 5700 rev/min was fitted with three coated inlet valves, a partially coated inlet valve and two uncoated inlet valves. As in Example 1, the coating consisted of a 0.3 mm thick layer, 96% by weight of which consisted of cerium (IV) oxide. The engine was operated with the same fuel as the engine in Example 1. After covering a distance of about 25,000 km in normal road traffic, coke deposits of about 1 mm thick were evident on the uncoated valves, the coated valves were free of deposits and the partially coated valve carried no deposits at the coated points, but the uncoated parts were covered with a coke layer about 1 mm thick.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Coated valve for internal combustion engine, comprising:

a valve;

a deposit preventing layer disposed over at least a portion of said valve, said deposit preventing layer including at least 90% by weight of cerium (IV) oxide.

2. Coated valve as in claim 1, wherein said deposit preventing layer has a thickness of about 0.1 mm to 1.5 mm.

3. Coated valve as in claim 2, wherein said deposit preventing layer has a thickness of about 0.15 mm to 0.4 mm.

4. Coated valve as in claim 1, wherein said valve includes a rear part of a valve head and a valve stem adjacent thereto, said deposit preventing layer being disposed only on said rear part of the valve head and on at least a portion of said valve stem adjacent thereto.

5. Coated valve as in claim 1, wherein said deposit preventing layer is a thermal jet sprayed layer.

6. Process of coating a valve for internal combustion engines, comprising:

preparing a material containing cerium (IV) oxide;

applying a deposit preventing layer of said material containing at least 90% by weight of cerium (IV) oxide to at least a portion of said valve.

7. Process as in claim 6, wherein said applying of said deposit preventing layer includes thermal jet spraying said deposit preventing layer on at least a portion of said valve.

8. Process as in claim 6, wherein said applying of said deposit preventing layer includes applying said deposit preventing layer only on a rear part of a valve head of said valve and on at least a portion of a valve stem adjacent thereto.

* * * * *